US008535606B2

(12) United States Patent
John

(10) Patent No.: US 8,535,606 B2
(45) Date of Patent: Sep. 17, 2013

(54) PITTING CORROSION RESISTANT NON-MAGNETIC STAINLESS STEEL

(75) Inventor: Hendrik John, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 608 days.

(21) Appl. No.: 12/499,842

(22) Filed: Jul. 9, 2009

(65) Prior Publication Data

US 2010/0012232 A1 Jan. 21, 2010

Related U.S. Application Data

(60) Provisional application No. 61/079,924, filed on Jul. 11, 2008.

(51) Int. Cl.
*C22C 38/58* (2006.01)
*C22C 38/34* (2006.01)

(52) U.S. Cl.
USPC ..... 420/57; 420/58; 420/59; 420/40; 420/35; 420/73; 420/74; 420/76; 148/327; 148/649

(58) Field of Classification Search
USPC ..... 420/57, 58, 59, 73, 74, 76, 35, 40; 148/327, 649
See application file for complete search history.

(56) References Cited

U.S. PATENT DOCUMENTS

| | | | | |
|---|---|---|---|---|
| 5,906,791 | A * | 5/1999 | Angeliu | 420/40 |
| 2005/0145308 | A1 | 7/2005 | Saller et al. | |
| 2005/0178477 | A1 | 8/2005 | Igarashi et al. | |
| 2007/0089810 | A1 | 4/2007 | Sundstrom et al. | |
| 2008/0000554 | A1 | 1/2008 | Yaguchi et al. | |
| 2010/0272593 | A1 | 10/2010 | Ishikawa et al. | |

FOREIGN PATENT DOCUMENTS

EP 2248919 A1 11/2010

OTHER PUBLICATIONS

Hand-English translation of Japanese patent 59-205451, Rikio Nemoto et al. Nov. 21, 1984.*
Machine-English translation of Japanese patent 10-121203, Okabe Takeshi, May 12, 1998.*
Rob Dekkers, Ph.D. Thesis, Katholieke Universiteit Leuven, Belguim (2002), Chapter 2 Non-Metallic Inclusions in Steel: A Literature Review, pp. 7-17.
Ferrer et al., Thermomechanical Processing, Recrystallization, Grain Growth and Precipitation in Alloy 625, Nickel-Base Superalloy, 1993, Abstract, 1 page.
Laha et al., Improved Creep Strength and Creep Ductility of Type 347 Austenitic Stainless Steel through the Self-Healing Effect of Boron for Creep Cavitation, Metallurgical and Materials Transactions A, vol. 36A, Feb. 2005, pp. 399-409.
Llewellyn, Copper in steels, Ironmaking and Steelmaking 1995, vol. 22, No. 1, pp. 25-34.
Pepe et al., Cerium hybrid silica coatings on stainless steel AISI 304 substrate, Published Jun. 27, 2006, J Sol-Gel Sci Techn (2006) 39:131-138.
Sheinker, Effect of Rare Earth Additions on Stress Corrosion Cracking of 4340 Steel, Technical Report, Report date: Jan. 1978, Abstract, 1 page.
Sreekumari et al., Silver Containing Stainless Steel as a New Outlook to Abate Bacterial Adhesion and Microbiologically Influenced Corrosion, ISIJ International, vol. 43 (2003), No. 11, pp. 1799-1806.
van der Eijk et al., Grain Refinement of Fully Austenitic Stainless Steels Using a Fe-Cr-Si-Ce Master Alloy, 59th Electric Furnace and 19th Process Technology Conferences, Phoenix Civic Plaza Convention Center, Phoenix, AZ, Nov. 11-14, 2001, 10 pages.
SU1774966A3; Dec. 22, 1989; Certified Human Translation (12 pages).
W02005116285A1; Dec. 8, 2008; Abstract Only (1 page).
Written Opinion of the International Searching Authority; International Application No. PCT/US2009/050252; International Filing Date Jul. 10, 2009; 5 pages.
International Search Report; International Application No. PCT/US2009/050252; International Filing Date Jul. 10, 2009; 3 pages.
JP62-156257; Jul. 11, 1987; Abstract Only (1 pages).
JP 10-121203; May 12, 1998; Abstract Only (1 page).
KR 10-2006-0075727; Jul. 4, 2006; KR Unexamined Patent Publication(A); Machine Translation (7 pages).
KR 10-2006-0025873; Mar. 22, 2006; KR Unexamined Patent Publication(A); Machine Translation (6 pages).

* cited by examiner

*Primary Examiner* — Deborah Yee
(74) *Attorney, Agent, or Firm* — Cantor Colburn LLP

(57) ABSTRACT

Disclosed are corrosion resistant, non-magnetic austenitic stainless steels containing alloying elements molybdenum, nickel, and copper and further containing small quantities of an additional element selected from the group consisting of a rare-earth element, calcium, cobalt, iridium, osmium, rhenium, rhodium, ruthenium, silver, and a combination thereof.

22 Claims, No Drawings

PITTING CORROSION RESISTANT NON-MAGNETIC STAINLESS STEEL

CROSS REFERENCE TO RELATED APPLICATION

This application claims the benefit of U.S. Provisional Application Ser. No. 61/079,924 filed Jul. 11, 2008, which is hereby incorporated by reference in its entirety.

BACKGROUND

Non-magnetic, austenitic stainless steels have been developed in recent years to meet the needs of applications and equipment requiring material having low relative magnetic permeability, such as in the medical instrument industry, oil field industry for deep drilling, electrical industry, etc.

Although stainless steels are relatively corrosion resistant in many conditions, certain environments render the material more susceptible to a variety of corrosive effects. For example, in oil field drilling and natural gas exploration, the environment of use includes a high chloride content due to sea water. In such working environments, pitting corrosion can occur, a localized form of corrosion. Pitting corrosion can occur or be accelerated in environments containing halides, for example chloride-rich sea water, fluorides, and iodides; and other anions such as thiosulfates. Additionally, stainless steel, like other high-strength alloys, is susceptible to corrosion fatigue due to exposure to a corrosive environment. Pitting can also contribute to corrosion fatigue.

There remains a need in the art for non-magnetic stainless steel having improved corrosion resistance, specifically pitting corrosion resistance and corrosion fatigue resistance.

SUMMARY

In one embodiment, a corrosion resistant non-magnetic austenitic stainless steel comprises about 17.0 to about 20.0 weight percent chromium, about 0.7 to about 2.5 weight percent copper, about 17.5 to about 19.5 weight percent manganese, about 1.85 to about 3.00 weight percent molybdenum, about 3.5 to about 5.0 weight percent nickel, about 0.55 to about 0.70 weight percent nitrogen, about 0.001 to about 0.5 weight percent of an additional element selected from the group consisting of a rare-earth element, calcium, cobalt, iridium, osmium, rhenium, rhodium, ruthenium, silver and a combination thereof wherein the about 0.001 to about 0.5 weight percent is per individual additional element if more than one is present, and the remainder is iron and optionally further comprising impurities relating to the production process; wherein all the amounts are in weight percent based on the total weight of the non-magnetic austenitic stainless steel; and wherein the non-magnetic austenitic stainless steel has corrosion fatigue resistance and pitting corrosion resistance.

In another embodiment, a corrosion resistant non-magnetic austenitic stainless steel comprises about 0.001 to about 0.5 weight percent of an element selected from the group consisting of a rare-earth element, calcium, cobalt, iridium, osmium, rhenium, rhodium, ruthenium, silver and a combination thereof wherein the about 0.001 to about 0.5 weight percent is per individual additional element if more than one is present, wherein all the amounts are in weight percent based on the total weight of the non-magnetic austenitic stainless steel; and wherein the non-magnetic austenitic stainless steel has corrosion fatigue resistance and pitting corrosion resistance.

In yet another embodiment, a process for making a non-magnetic austenitic stainless steel comprises hot forging an alloy at a temperature of about 230° C. to about 970° C. and quickly cooling the hot forged alloy to form a austenitic, single-phase, corrosion resistant non-magnetic stainless steel substantially free of precipitations on the grain boundaries and within the grains; wherein the corrosion resistant non-magnetic stainless steel comprises 0 to 0.03 weight percent carbon, about 17.0 to about 20.0 weight percent chromium, about 0.7 to about 2.5 weight percent copper, about 17.5 to about 19.5 weight percent manganese, about 1.85 to about 3.00 weight percent molybdenum, about 3.5 to about 5.0 weight percent nickel, about 0.55 to about 0.70 weight percent nitrogen, about 0.001 to about 0.5 weight percent of an additional element selected from the group consisting of a rare-earth element, calcium, cobalt, iridium, osmium, rhenium, rhodium, ruthenium, silver and a combination thereof wherein the about 0.001 to about 0.5 weight percent is per individual additional element if more than one is present, and the remainder is iron and optionally further comprising impurities relating to the production process; wherein all the amounts are in weight percent based on the total weight of the non-magnetic austenitic stainless steel.

DETAILED DESCRIPTION

Disclosed herein are corrosion resistant non-magnetic austenitic stainless steels (NMSS) having increased pitting corrosion resistance and increased general corrosion resistance. The improved corrosion resistance can be obtained by increasing the content of alloying elements molybdenum, nickel, and copper present in the NMSS and further adding small quantities of an additional element selected from the group consisting of a rare-earth element, calcium, cobalt, iridium, osmium, rhenium, rhodium, ruthenium, silver, and a combination thereof.

Exemplary rare-earth elements include the lanthanides (lanthanum, cerium, praseodymium, neodymium, promethium, samarium, europium, gadolinium, terbium, dysprosium, holmium, erbium, thulium, ytterbium, and lutetium), scandium, and yttrium.

It has been found that both pitting resistance and corrosion fatigue resistance can be significantly increased by using specific alloying elements (i.e., rare-earth element, calcium, cobalt, iridium, osmium, rhenium, rhodium, ruthenium, silver and a combination thereof) and by taking advantage of the synergistic effect of the alloying elements (e.g., synergism provided by the combination of copper and silver; combination of copper, silver and elements of the platinum group; or combination of copper, silver, elements of platinum group, and/or rare earth elements). Excellent corrosion resistance can be achieved in a cost-effective manner without resorting to large amounts of expensive alloying elements such as nickel, chromium, and molybdenum.

The pitting corrosion resistance and corrosion fatigue resistance can be increased by increasing the content of alloying elements molybdenum, nickel, and copper. For example, a NMSS comprising about 0.8 copper, 2.0 molybdenum, 4.0 nickel, and 0.65 nitrogen, all amounts in weight percent based on the total weight of the NMSS, was found to exhibit superior corrosion behavior as compared to NMSS containing lower amounts of each of the three alloying elements according to a weight loss test in 10% hydrochloric acid with increasing temperature stepwise from room temperature to 80° C.

The corrosion resistant non-magnetic stainless steel generally contains molybdenum in an amount of about 1.85 to about 3.0, specifically about 2.0 to about 2.70, and yet more specifically about 2.2 to about 2.5 weight percent based on the total weight of the NMSS.

The corrosion resistant non-magnetic stainless steel generally contains nickel in an amount of about 3.5 to about 5.0, specifically about 3.7 to about 4.80, and yet more specifically about 3.9 to about 4.60 weight percent based on the total weight of the NMSS.

The corrosion resistant non-magnetic stainless steel generally contains chromium in an amount of about 17.0 to about 20.0, specifically about 17.6 to about 19.4, and yet more specifically about 18.2 to about 18.8 weight percent based on the total weight of the NMSS.

The corrosion resistant non-magnetic stainless steel generally contains manganese in an amount of about 17.5 to about 19.5, specifically about 17.9 to about 19.1, and yet more specifically about 18.3 to about 18.7 weight percent based on the total weight of the NMSS.

The corrosion resistant non-magnetic stainless steel generally contains copper in an amount of about 0.7 to about 2.5, specifically about 1.0 to about 2.20, and yet more specifically about 1.3 to about 1.9 weight percent based on the total weight of the NMSS.

In addition to iron, copper, molybdenum, and nickel, the corrosion resistant non-magnetic stainless steel can contain an additional element selected from the group consisting of a rare-earth element, calcium, cobalt, iridium, osmium, rhenium, rhodium, ruthenium, silver, and a combination thereof in an amount of about 0.001 to about 0.5 for each individual additional element (such that the sum amount of two or more additional elements can be greater than 0.5), specifically about 0.01 to about 0.4, more specifically about 0.05 to about 0.3, and yet more specifically about 0.1 to about 0.2 weight percent for each individual additional element based on the total weight of the NMSS.

The corrosion resistant non-magnetic stainless steel generally contains less than or equal to 0.03 weight percent carbon based on the total weight of the NMSS, specifically about 0.0001 to about 0.02, and yet more specifically about 0.001 to about 0.01 weight percent carbon.

The corrosion resistant non-magnetic stainless steel generally contains less than or equal to 0.70 weight percent silicon based on the total weight of the NMSS, specifically about 0.0001 to about 0.4, and yet more specifically about 0.001 to about 0.1 weight percent silicon.

The corrosion resistant non-magnetic stainless steel generally contains less than or equal to 0.03 weight percent phosphorus based on the total weight of the NMSS, specifically about 0.0001 to about 0.02, and yet more specifically about 0.001 to about 0.01 weight percent phosphorus.

The corrosion resistant non-magnetic stainless steel generally contains less than or equal to 0.005 weight percent sulfur based on the total weight of the NMSS, specifically about 0.0001 to about 0.004, and yet more specifically about 0.001 to about 0.003 weight percent sulfur.

The corrosion resistant non-magnetic stainless steel may contain boron in an amount of about 0.002 to about 0.005, specifically about 0.003 to about 0.004, and yet more specifically about 0.0033 to about 0.0036 weight percent based on the total weight of the NMSS.

The corrosion resistant non-magnetic stainless steel may contain nitrogen in an amount of about 0.55 to about 0.70, specifically about 0.58 to about 0.67, and yet more specifically about 0.61 to about 0.64 weight percent based on the total weight of the NMSS.

In one embodiment, the corrosion resistant NMSS comprises (in weight percent based on the total weight of the NMSS) carbon=maximum 0.03, manganese=about 18.0 to about 19.50, silicon=maximum 0.50, phosphorus=maximum 0.03, sulfur=maximum 0.005, chromium=about 17.0 to about 18.5, molybdenum about 1.85 to about 2.70, boron=about 0.002 to about 0.005, nitrogen=about 0.55 to about 0.70 and an additional element selected from the group consisting of a rare-earth element, calcium, cobalt, iridium, osmium, rhenium, rhodium, ruthenium, silver, and a combination thereof in an amount of about 0.001 to about 0.5 for each individual additional element.

The corrosion resistant stainless steel contains minimal amounts of ferrite and contains a substantially austenitic basic structure. In one embodiment, the corrosion resistant stainless steel is substantially free of ferrite and has a relative magnetic permeability of less than about 1.01.

The corrosion resistant non-magnetic stainless steel generally has a relative magnetic permeability below about 1.01, specifically about 1.001 to about 1.0075, and more specifically about 1.002 to about 1.005. The relative magnetic permeability of a material can be determined using an eddy current sensor, for example a Foerster Permeability Probe 1.005-1522.

The formation of the corrosion resistant steel can be obtained when the thermo-mechanical manufacturing process of the forging is controlled in a way that the steel maintains its paramagnetic properties and is free of foreign phases (e.g, sigma phase and chi phase) and precipitation on the grain boundaries and within the grains.

A method of preparing the corrosion resistant NMSS involves melting of basic analysis using an electric arc furnace melting procedure. Secondary refining of the material can be performed in an Argon-Oxygen Decarburization (AOD) process using argon/oxygen converter to decarburize, refine, and adjust the analysis. The use of AOD process allows for the preparation of material containing low sulfur and oxygen levels.

Ingots of the alloy are then cast and subsequently hot forged at temperatures of about 1230 to about 970° C., specifically about 1180 to about 1020° C., and more specifically about 1130 to about 1070° C. Control of the forging temperature and amount of hot work maintains the alloy's paramagnetic properties and limits precipitation on the grain boundaries and within the grains. An exemplary forging process includes rotary forging as opposed to machined press forging. The resulting cast microstructure has a uniform, fine-grained recrystallized microstructure with an ASTM grain size number higher than 5.

The material can then be cold forged to provide strength, and finally finished (e.g., by bar peeling/machining) as needed for the particular application.

The corrosion resistant non-magnetic stainless steel is particularly suited for structural parts, specifically drilling systems tools such as outer drill string components for oilfield drilling and natural gas exploration. Exemplary outer drill string components include logging while drilling (LWD) tools containing magnetic field probes. Furthermore, due to its low permeability, the corrosion resistant non-magnetic stainless steel is suitable for the preparation of medical instruments, analytical tools, generators, and the like.

The following non-limiting examples further illustrate the various embodiments described herein.

EXAMPLES

Several alloys are prepared by adding additional elements and other alloying elements to a master alloy and remelting the mixture to prepare ingots. Remelting is conducted in an induction furnace using a protective atmosphere (Nitrogen). The molten metal is cooled under nitrogen atmosphere in the oven. Table 1 provides examples of corrosion resistant non-magnetic austenitic stainless steel formulations.

TABLE 1

| | Composition (amounts in weight percent) | | | |
|---|---|---|---|---|
| | A | B | C | D |
| Master Alloy Element | | | | |
| C | 0.025 | 0.025 | 0.025 | 0.025 |
| Cr | 18.00 | 18.00 | 18.00 | 18.00 |
| Cu | 0.65 | 0.65 | 0.65 | 0.65 |
| Mn | 19.50 | 19.50 | 19.50 | 19.50 |
| Mo | 2.10 | 2.10 | 2.10 | 2.10 |
| N | 0.64 | 0.64 | 0.64 | 0.64 |
| Ni | 4.10 | 4.10 | 4.10 | 4.10 |
| P | Not more than 0.03 | Not more than 0.03 | Not more than 0.03 | Not more than 0.03 |
| S | Not more than 0.005 | Not more than 0.005 | Not more than 0.005 | Not more than 0.005 |
| Si | Not more than 0.70 | Not more than 0.70 | Not more than 0.70 | Not more than 0.70 |
| Additional element | | | | |
| Ag | 0.10 | 0.10 | 0.10 | 0.10 |
| Ce | — | — | 0.10 | 0.10 |
| Co | — | — | — | 0.50 |
| Cu | 0.40 | 0.40 | 0.40 | 0.40 |
| Ru | — | 0.05 | 0.05 | 0.05 |

Corrosion tests are performed on the samples taken directly from the prepared ingots by placing samples in 10% hydrochloric acid with increasing temperature stepwise from room temperature to 80° C. and measuring weight loss.

Composition A exhibited significantly less corrosion than a comparative non-magnetic stainless steel (P650 commercially available from Schoeller Bleckmann Oilfield Technology) under the same testing conditions.

TABLE 2

| Material | Weight change (grams/centimeter$^2$) |
|---|---|
| Composition A | −0.016 |
| Comparative NMSS P650 | −0.249 |

The terms "a" and "an" do not denote a limitation of quantity, but rather denote the presence of at least one of the referenced item. The endpoints of all ranges directed to the same component or property are inclusive of the endpoint and independently combinable. The term "or" means "and/or".

While preferred embodiments have been shown and described, modifications and substitutions may be made thereto without departing from the spirit and scope of the invention. Accordingly, it is to be understood that the present invention has been described by way of illustrations and not limitation.

What is claimed:

1. A corrosion resistant non-magnetic austenitic stainless steel, comprising:

about 17.0 to about 20.0 weight percent chromium, about 0.7 to about 2.5 weight percent copper, about 17.5 to about 19.5 weight percent manganese, about 1.85 to about 3.00 weight percent molybdenum, about 3.5 to about 5.0 weight percent nickel, about 0.55 to about 0.70 weight percent nitrogen, about 0.001 to about 0.5 weight percent of an additional element selected from the group consisting of a rare-earth element, calcium, iridium, osmium, rhenium, rhodium, ruthenium, silver, and a combination thereof wherein the about 0.001 to about 0.5 weight percent is per individual additional element, and iron;

wherein all the amounts are in weight percent based on the total weight of the non-magnetic austenitic stainless steel; and wherein the non-magnetic austenitic stainless steel has corrosion fatigue resistance and pitting corrosion resistance.

2. The non-magnetic austenitic stainless steel of claim 1, further comprising:

about 0.001 to about 0.5 weight percent cobalt;

about 0.002 to about 0.005 weight percent boron, 0 to 0.03 weight percent carbon, 0 to 0.03 weight percent phosphorus, 0 to 0.70 weight percent silicon, and 0 to 0.005 weight percent sulfur, wherein all the amounts are in weight percent based on the total weight of the non-magnetic austenitic stainless steel.

3. The non-magnetic austenitic stainless steel of claim 1, wherein the additional element is a rare earth element selected from the group consisting of lanthanum, cerium, praseodymium, neodymium, promethium, samarium, europium, gadolinium, terbium, dysprosium, holmium, erbium, thulium, ytterbium, and lutetium, scandium, and yttrium.

4. The non-magnetic austenitic stainless steel of claim 1, wherein the additional element is selected from the group consisting of iridium, osmium, rhenium, rhodium, ruthenium, and a combination thereof.

5. The non-magnetic austenitic stainless steel of claim 1, wherein the additional element is calcium, cerium, ruthenium, silver, or a combination thereof.

6. The non-magnetic austenitic stainless steel of claim 1, wherein the additional element is silver.

7. The non-magnetic austenitic stainless steel of claim 1, wherein the additional element is a combination of cerium and silver.

8. The non-magnetic austenitic stainless steel of claim 1, wherein the additional element is a combination of ruthenium and silver.

9. The non-magnetic austenitic stainless steel of claim 1, wherein the additional element is a combination of cerium, ruthenium, and silver.

10. The non-magnetic austenitic stainless steel of claim 1, wherein the additional element is a combination of cerium, ruthenium, and silver; and further comprising cobalt.

11. The non-magnetic austenitic stainless steel of claim 1, comprising about 0.01 to about 0.3 weight percent per individual additional element.

12. The non-magnetic austenitic stainless steel of claim 1, comprising about 0.05 to about 0.2 weight percent per individual additional element.

13. The non-magnetic austenitic stainless steel of claim 1, comprising about 0.01 to about 0.1 weight percent per individual additional element.

14. The non-magnetic austenitic stainless steel of claim 1, comprising about 1.0 to about 2.20 weight percent copper.

15. The non-magnetic austenitic stainless steel of claim 1, comprising about 2.0 to about 2.70 weight percent molybdenum.

16. The non-magnetic austenitic stainless steel of claim 1, comprising about 3.7 to about 4.8 weight percent nickel.

17. The non-magnetic austenitic stainless steel of claim 1, having a relative magnetic permeability below about 1.01.

18. The non-magnetic austenitic stainless steel of claim 1, having a relative magnetic permeability of about 1.001 to about 1.0075.

19. The non-magnetic austenitic stainless steel of claim 1, having a relative magnetic permeability of about 1.002 to about 1.005.

20. A corrosion resistant non-magnetic austenitic stainless steel, comprising:

about 17.0 to about 20.0 weight percent chromium, about 17.5 to about 19.5 weight percent manganese, about 3.5 to about 5.0 weight percent nickel, and about 0.001 to about 0.5 weight percent of an element selected from the group consisting of a rare-earth element, calcium, iridium, osmium, rhenium, rhodium, ruthenium, silver and a combination thereof wherein the about 0.001 to about 0.5 weight percent is per individual additional element, wherein all the amounts are in weight percent based on the total weight of the non-magnetic austenitic stainless steel; and wherein the non-magnetic austenitic stainless steel has corrosion fatigue resistance and pitting corrosion resistance.

21. A process for making a non-magnetic austenitic stainless steel, comprising:

hot forging an alloy at a temperature of about 1230° C. to about 970° C. and quickly cooling the hot forged alloy to form an austenitic, single-phase, corrosion resistant non-magnetic stainless steel substantially free of precipitations on the grain boundaries and within the grains;

wherein the corrosion resistant non-magnetic stainless steel comprises 0 to 0.03 weight percent carbon, about 17.0 to about 20.0 weight percent chromium, about 0.7 to about 2.5 weight percent copper, about 17.5 to about 19.5 weight percent manganese, about 1.85 to about 3.00 weight percent molybdenum, about 3.5 to about 5.0 weight percent nickel, about 0.55 to about 0.70 weight percent nitrogen, about 0.001 to about 0.5 weight percent of an additional element selected from the group consisting of a rare-earth element, calcium, iridium, osmium, rhenium, rhodium, ruthenium, silver and a combination thereof wherein the about 0.001 to about 0.5 weight percent is per individual additional element, and iron;

wherein all the amounts are in weight percent based on the total weight of the non-magnetic austenitic stainless steel.

22. A corrosion resistant non-magnetic austenitic stainless steel, comprising:

about 17.0 to about 20.0 weight percent chromium, about 1.05 to about 2.5 weight percent copper, about 17.5 to about 19.5 weight percent manganese, about 2.00 to about 3.00 weight percent molybdenum, about 3.5 to about 5.0 weight percent nickel, about 0.55 to about 0.70 weight percent nitrogen, an additional element selected from the group consisting of a rare-earth element, calcium, iridium, osmium, rhenium, rhodium, ruthenium, silver and a combination thereof, and iron;

wherein all the amounts are in weight percent based on the total weight of the non-magnetic austenitic stainless steel; and wherein the non-magnetic austenitic stainless steel has corrosion fatigue resistance and pitting corrosion resistance.

* * * * *